US010249256B2

(12) United States Patent
Park et al.

(10) Patent No.: US 10,249,256 B2
(45) Date of Patent: Apr. 2, 2019

(54) DISPLAY PANEL HAVING A PLURALITY OF DISPLAY AREAS, A DISPLAY APPARATUS HAVING THE SAME AND A METHOD OF DRIVING THE SAME

(71) Applicant: SAMSUNG DISPLAY CO., LTD., Yongin-si, Gyeonggi-Do (KR)

(72) Inventors: Kee-Bum Park, Cheonan-si (KR); Seungsoo Baek, Hwaseong-si (KR); Kye-Uk Lee, Hwaseong-si (KR); Yoomi Ra, Ansan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/344,842

(22) Filed: Nov. 7, 2016

(65) Prior Publication Data

US 2017/0154598 A1 Jun. 1, 2017

(30) Foreign Application Priority Data

Nov. 27, 2015 (KR) ..... 10-2015-0167529

(51) Int. Cl.
*G09G 5/02* (2006.01)
*G09G 3/36* (2006.01)

(52) U.S. Cl.
CPC ..... *G09G 3/3688* (2013.01); *G09G 3/3666* (2013.01); *G09G 3/3677* (2013.01); *G09G 2300/0426* (2013.01); *G09G 2310/08* (2013.01)

(58) Field of Classification Search
CPC ..... G09G 3/3688
USPC ..... 345/694
See application file for complete search history.

(56) References Cited

U.S. PATENT DOCUMENTS

| | | | | |
|---|---|---|---|---|
| 8,487,862 | B2 | 7/2013 | Chiang | |
| 2003/0043097 | A1* | 3/2003 | Shingai | G09G 3/3666 345/87 |
| 2007/0109254 | A1* | 5/2007 | Kang | G09G 3/342 345/103 |
| 2015/0123959 | A1* | 5/2015 | Yatabe | G09G 3/3666 345/209 |
| 2015/0243212 | A1* | 8/2015 | Lee | G09G 3/3216 345/212 |

* cited by examiner

*Primary Examiner* — Long D Pham
(74) *Attorney, Agent, or Firm* — F. Chau & Associates, LLC

(57) ABSTRACT

A display panel includes a plurality of first pixel rows comprising a plurality of first pixels which is connected to a plurality of first data lines, a plurality of second pixel rows comprising a plurality of second pixels which is connected to a plurality of second data lines disconnected to the plurality of first data lines, and a plurality of third pixel rows comprising the plurality of first pixels and the plurality of second pixels, the plurality of third pixel rows which are arranged between the plurality of first pixel rows and the plurality of second pixel rows.

16 Claims, 7 Drawing Sheets

DISPLAY PANEL HAVING A PLURALITY OF DISPLAY AREAS, A DISPLAY APPARATUS HAVING THE SAME AND A METHOD OF DRIVING THE SAME

This application claims priority under 35 U.S.C. § 119 to Korean Patent Application No. 10-2015-0167529 filed on Nov. 27, 2015, in the Korean Intellectual Property Office, the disclosure of which is incorporated by reference herein in its entirety.

TECHNICAL FIELD

The inventive concept relates to a display panel, a display apparatus having the display panel and a method of driving the display apparatus.

DISCUSSION OF RELATED ART

Generally, a liquid crystal display ('LCD') panel may include an array substrate which includes a plurality of pixel electrodes connected to a plurality of signal lines and an opposing substrate which is opposite to the array substrate. The pixel electrodes are arranged as a matrix in a display area of the array substrate. A liquid crystal ('LC') layer is disposed between the array substrate and the opposing substrate. The LC layer is controlled by a control signal applied to the pixel electrodes.

The LCD panel may be used in a display apparatus having an ultra high definition ('UHD'), for example, a resolution of (3840×2160). The LCD panel having an UHD may be divided into an upper area and lower area. The upper and lower areas may be individually driven.

The display apparatus divided into the upper and lower areas may have defects in a boundary area between the upper and lower areas. For example, a horizontal line may be in a cut portion disconnecting an upper data line disposed in the upper area and a lower data line disposed in the lower area.

SUMMARY

According to an exemplary embodiment of the inventive concept, a display panel includes a plurality of first pixel rows, a plurality of second pixel rows, a plurality of third pixel rows, a first data driver and a second data driver. The plurality of first pixel rows including a plurality of first pixels. The plurality of first pixels is connected to a plurality of first data lines. The plurality of second pixel rows including a plurality of second pixels. The plurality of second pixels is connected to a plurality of second data lines disconnected from the plurality of first data lines. The plurality of third pixel rows includes a portion of the plurality of first pixels and a portion of the plurality of second pixels. The plurality of third pixel rows is arranged between the plurality of fist pixel rows and the plurality of second pixel rows.

In an exemplary embodiment of the inventive concept, the plurality of first pixel rows may be arranged in an upper display area of the display panel. The plurality of second pixel rows may be arranged in a lower display area of the display panel.

In an exemplary embodiment of the inventive concept, the display panel may include a plurality of gate lines and a plurality of cut portion. The plurality of gate lines may cross the first and second data lines. The plurality of cut portions may disconnect the plurality of first data lines and the plurality of second data lines. The plurality of cut portions may be disposed in a boundary display area in which the plurality of third pixel rows is arranged, and be arranged in a zigzag shape.

According to an exemplary embodiment of the inventive concept, a display apparatus including a display panel, a plurality of first pixel rows, a plurality of second pixel rows, a plurality of third pixel rows, a first gate driver and a second gate driver. The display panel includes a first display area, a second display area and a third display area between the first and second display areas. The plurality of first pixel rows includes a plurality of first pixels. The plurality of first pixels is connected to a plurality of first data lines and arranged in the first display area. The plurality of second pixel rows includes a plurality of second pixels. The plurality of second pixels is connected to a plurality of second data lines and disconnected from the plurality of first data lines and arranged in the second display area. The plurality of third pixel rows includes a portion of the plurality of first pixels and a portion of the plurality of second pixels and arranged in the third display area. The first gate driver starts to drive a plurality of first gate lines at a second time after the first time. The second gate driver starts to drive a plurality of second gate lines at a second time after the first time. The plurality of first pixel rows is driven by the first gate driver, the plurality of second pixel rows is driven by the second gate driver and the plurality of third pixel rows is driven by the first or second gate driver.

In an exemplary embodiment of the inventive concept, a difference between the first time and the second time may correspond to a plurality of horizontal periods.

In an exemplary embodiment of the inventive concept, the difference may correspond to a number of the plurality of third pixel rows.

In an exemplary embodiment of the inventive concept, the first gate driver may sequentially output a first gate signal in a first scan direction. The first gate signal may proceed from a central portion of the display panel to an upper portion of the display panel. The second gate driver may sequentially output a second gate signal in a second scan direction. The second gate signal may proceed from the central portion of the display panel to a lower portion of the display panel.

In an exemplary embodiment of the inventive concept, the plurality of first pixels and the plurality second pixels in the plurality of third pixel rows may be connected to the plurality of first gate lines, and a number of the first pixels in the plurality of third pixel rows may increase along the first scan direction.

In an exemplary embodiment of the inventive concept, the plurality of first pixels and the plurality of second pixels in the plurality of third pixel rows may be connected to the plurality of second gate lines, and a number of the second pixels in the plurality of third pixel rows may increase along the second scan direction.

In an exemplary embodiment of the inventive concept, the display panel may include a plurality of cut portions disconnecting the plurality of first data lines and the plurality of second data lines in the third display area. The plurality of cut portions may be arranged in a zigzag shape.

According to an exemplary embodiment of the inventive concept, a method of driving a display panel includes a first display area, a second display area and a third display area between the first and second display areas. The method includes sequentially driving a plurality of third pixel rows in the third display area during a first period, sequentially driving a plurality of first pixel rows in the first display area along a first scan direction during a second period and sequentially driving a plurality of second pixel rows in the second display area along a second scan direction opposite the first scan direction during the second period.

In an exemplary embodiment of the inventive concept, the plurality of first pixel rows may include a plurality of first pixels. The plurality of first pixels is connected to a plurality of first data lines. The plurality of second pixel rows may include a plurality of second pixels. The plurality of second pixels is connected to a plurality of first data lines. The plurality of third pixel rows may include a portion of the plurality of first pixels and a portion of the plurality of second pixels.

In an exemplary embodiment of the inventive concept, the display panel may include a plurality of cut portions disconnecting the plurality of first data lines and the plurality of second data lines in the third display area. The plurality of cut portions may be arranged in a zigzag shape.

In an exemplary embodiment of the inventive concept, the plurality of third pixel rows may be sequentially driven along the first scan direction.

In an exemplary embodiment of the inventive concept, the plurality of third pixel rows may be sequentially driven along the second scan direction.

According to an exemplary embodiment of the inventive concept, a display panel includes a boundary area, a first data driver, a second data driver and a plurality of cut portions. The boundary area includes a plurality of first pixels and a plurality of second pixels. The first data driver is connected to the plurality of first pixels by a plurality of first data lines. The second data driver is connected to the plurality of second pixels by a plurality of second data lines. The plurality of cut portions separating the plurality of first data lines and the plurality of second data lines from each other.

In an exemplary embodiment of the inventive concept, the plurality of first pixels and the plurality of second pixels may form a plurality of rows in the boundary area. The plurality of cut portions may be non-linearly arranged.

In an exemplary embodiment of the inventive concept, the plurality of cut portions may have a zigzag shape.

In an exemplary embodiment of the inventive concept, the display panel may include a first area, a second area, a first gate driver and a second gate driver. The first area may include a plurality of third pixels. The second area may include a plurality of fourth pixels. The first gate driver may be connected to the plurality of first pixels, the plurality of second pixels and the plurality of third pixels. The second gate driver may be connected to the plurality of fourth pixels.

In an exemplary embodiment of the inventive concept, the first gate driver may drive the plurality of first pixels and the plurality of second pixels and, after a time delay, the first gate driver may drive the plurality of third pixels and the second gate driver may drive the plurality of fourth pixels.

BRIEF DESCRIPTION OF THE DRAWINGS

The above and other features of the inventive concept will become more apparent by describing in detailed exemplary embodiments thereof with reference to the accompanying drawings, in which.

DETAILED DESCRIPTION OF THE EMBODIMENTS

Hereinafter, exemplary embodiments of the inventive concept will be explained in detail with reference to the accompanying drawings.

Figure 1:
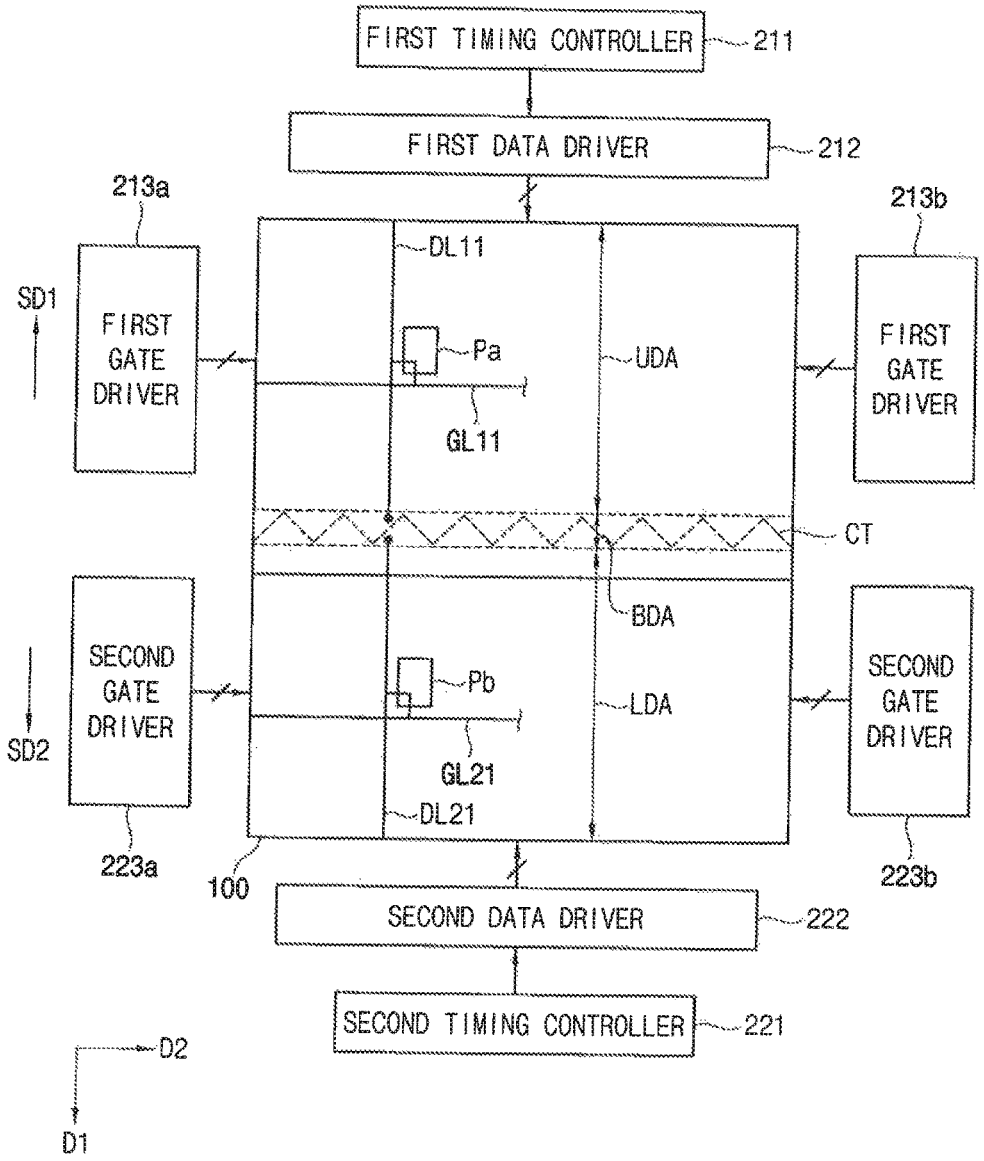
FIG. 1 is a block diagram illustrating a display apparatus according to an exemplary embodiment of the inventive concept.

FIG. 1 is a block diagram illustrating a display apparatus according to an exemplary embodiment of the inventive concept.

Referring to FIG. 1, the display apparatus may include a display panel 100, a first timing controller 211, a first data driver 212, first gate drivers 213*a* and 213*b*, a second timing controller 221, a second data driver 222 and second gate drivers 223*a* and 223*b*.

The display panel 100 may be a large panel having an ultra high definition ('UHD') resolution. The display panel 100 includes a display area in which a plurality of pixels is arranged in a matrix. The display area includes a first (upper) display area UDA, a second (lower) display area LDA and a third (boundary) display area BDA between the upper and the lower display areas UDA and LDA. The upper and the lower display areas UDA and LDA may be individually driven to decrease an RC delay of the large panel.

The upper display area UDA may include a plurality of first (upper) data lines DL11, a plurality of first (upper) gate lines GL11 and a plurality of first (upper) pixels Pa. The upper data lines DL11 extend in a first direction D1 and are arranged in a second direction D2 crossing the first direction Dl. The upper gate lines GL11 extend in the second direction D2 and are arranged in the first direction D1. An upper pixel Pa may be connected to an upper data line DL11 and an upper gate line GL11 in a one gate one data (1G1D) type. The first direction D1 and the second direction D2 may be substantially perpendicular to each other.

The lower display area LDA may include a plurality of second (lower) data lines DL21, a plurality of second (lower) gate lines GL21 and plurality of (second) lower pixels Pb. The lower data lines DL21 extend in the first direction D1 and are arranged in the second direction D2. The lower gate lines GL21 extend in the second direction D2 and are arranged in the first direction D1. A lower pixel Pb may be connected to a lower data line DL21 and a lower gate line GL21 in a 1G1D type.

The upper pixels Pa connected to the upper data lines DL11 and the lower pixels Pb connected to the lower data lines DL21 may be disposed in the boundary display area BDA. The upper pixel and lower pixel disposed in the boundary display area BDA may be connected to the upper gate line or the lower gate line. A plurality of cut portions CT is disposed in the boundary display area BDA. The upper data lines DL11 and the lower data lines DL21 are separated by the plurality of cut portions CT. The cut portions CT are arranged in the second direction D2 in a zigzag shape.

The first timing controller 211 generates a first display synchronization signal based on an external synchronization signal to drive the upper data lines and the upper gate lines. The first display synchronization signal may include a vertical start signal, a data enable signal, a vertical synchronization signal, a horizontal synchronization signal, a main clock signal and so on. The first timing controller 211 may operate as a master controller to control the second timing controller 221.

The first timing controller 211 provides the first data driver 212 with a first image signal corresponding to the upper pixels Pa connected to the upper data lines DL11.

The first data driver 212 may be disposed at an upper side of the display panel 100. The first data driver 212 converts the first image signal to a data voltage based on the first display synchronization signal and outputs the data voltage to the upper data lines DL11.

The first gate drivers 213*a* and 213*b* may be disposed at a left and a right side of the upper side of the display panel 100 respectively. The first gate drivers 213*a* and 213*b* may sequentially output a gate signal to the upper gate lines GL11 along a first scan direction SD1 based on the first display synchronization signal. The first scan direction SD1 proceeds from a central portion of the display panel 100 to the upper side of the display panel 100.

The second timing controller 221 generates a second display synchronization signal to drive the lower data lines DL21 and the lower gate lines GL21 based on the external synchronization signal. The second display synchronization signal may include a vertical start signal, a data enable signal, a vertical synchronization signal, a horizontal synchronization signal, a main clock signal and so on. The second timing controller 221 may operate as a slave controller controlled by the first timing controller 211.

The second timing controller 221 provides the second data driver 222 with a second image signal corresponding to the lower pixels Pb connected to the lower data lines DL21.

The second data driver 222 may be disposed at a lower side opposite to the upper side of the display panel 100. The second data driver 222 converts the second image signal to a data voltage based on the second display synchronization signal and outputs the data voltage to the lower data lines DL21.

The second gate drivers 223*a* and 223*b* may be disposed at a left and a right side of the lower side of the display panel 100 respectively. The second gate drivers 223*a* and 223*b* sequentially output a gate signal to the lower gate lines GL21 along a second scan direction SD2 opposite to the first scan direction SD1 based on the second display synchronization signal. The second scan direction SD2 proceeds from the central portion of the display panel 100 to the lower side of the display panel 100.

An operation time of the second gate drivers 223*a* and 223*b* is delayed by a plurality of horizontal periods from an operation time of the first gate drivers 213*a* and 213*b*. For example, the plurality of horizontal periods may correspond to a number of the pixel rows in the boundary display area BDA.

For example, the first gate drivers 213*a* and 213*b* drive at a first time and sequentially output a gate signal to the upper gate lines. The second gate drivers 223*a* and 223*b* drive at a second time delayed after the first gate drivers 213*a* and 213*b* by n horizontal periods from the first time and to sequentially output a gate signal to the lower gate lines. N may be a natural number greater than zero.

According to an exemplary embodiment of the inventive concept, the cut portions CT disconnecting the upper data lines in the upper display area and the lower data lines in the lower display area are arranged in a zigzag shape in the boundary display area. The zigzag shape may prevent the cut portions CT from being viewed as a horizontal line defect in a half-cut area of the boundary display area.

In an exemplary embodiment of the inventive concept, the cut portions CT may be arranged in other patterns similar to the zigzag shape. In a pattern, two data lines next to each other in the same row may be separated. This pattern may be repeated by shifting the cut portion CT by several data lines and a row, thereby forming an elongated zigzag shape. For example, with reference to FIG. 2*the* data lines DL21 and DL22 in a pixel row LR, the data lines DL23 and DL24 is a pixel row BR1, the data lines DL25, DL26 and DL 29 in a pixel row BR2 and the data lines DL27 and DL28 in a pixel row BR3 are separated.

Figure 2:
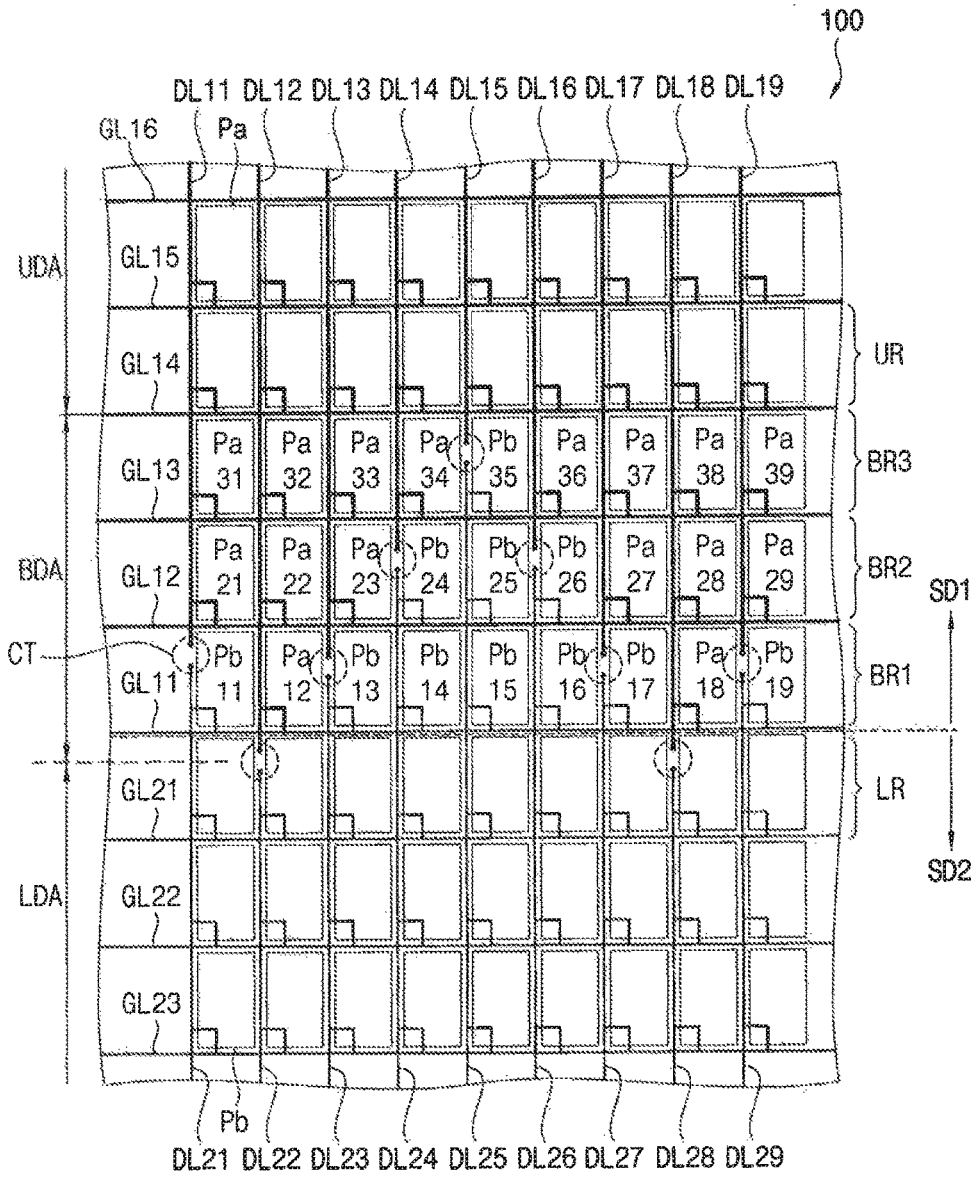
FIG. 2 is a plan diagram illustrating a display panel of FIG. 1 according to an exemplary embodiment of the inventive concept.

FIG. 2 is a plan diagram illustrating a display panel of FIG. 1 according to an exemplary embodiment of the inventive concept.

Referring to FIGS. 1 and 2, a display area of the display panel 100 includes an upper display area UDA, a lower display area LDA and a boundary display area BDA. In the upper display area UDA, a plurality of upper pixels driven by the first data driver 212 are arranged. In the lower display area LDA, a plurality of lower pixels driven by the second data driver 222 are arranged. The boundary display area BDA includes a portion of pixels from the plurality of upper pixels and the plurality of lower pixels.

In an exemplary embodiment of the inventive concept, a plurality of gate lines in the upper and boundary display area UDA and BDA may be driven by the first gate driver 213*a* and a plurality of gate lines in the lower display area LDA may be driven by the second gate driver 223*a*.

For example, a plurality of upper data lines DL11, DL12, DL13, DL14, DL15, DL16, DL17, DL18 and DL19, a plurality of upper gate lines GL11, GL12, GL13, GL14, GL15 and GL16 and a plurality of first (upper) pixel rows UR are arranged in the upper display area UDA. The upper pixel row includes a plurality of upper pixels Pa which is arranged in the direction of the upper gate line.

The upper data lines DL11, DL12, DL13, DL14, DL15, DL16, DL17, DL18 and DL19 are connected to output channels of a first data driver 212 which is disposed at a first side (e.g., upper side) of the display panel 100.

The upper gate lines GL11, GL12, GL13, GL14, GL15 and GL16 may be connected to output channels of the first gate drivers 213*a* and 213*b*. The first gate drivers 213*a* and 213*b* are respectively disposed at a third side (e.g., left side) and a fourth side (e.g., right side) opposite each other on the upper portion of the display panel 100.

The upper pixels Pa may receive data voltages through the upper data lines DL11, DL12, DL13, DL14, DL15, DL16, DL17, DL18 and DL19. The upper pixels Pa may receive gate signals through the upper gate lines GL11, GL12, GL13, GL14, GL15 and GL16.

A plurality of lower data lines DL21, DL22, DL23, DL24, DL25, DL26, DL27, DL28 and D1,29, a plurality of lower gate lines GL21, GL22 and GL23 and a plurality of second (lower) pixel rows LR are arranged in the lower display area LDA. The lower pixel row includes a plurality of lower pixels Pb which is arranged in an extension direction of the lower gate line.

The lower data lines DL21, DL22, DL23, DL24, DL25, DL26, DL27, DL28 and DL29 are connected to output channels of a second data driver 222 which is disposed at a second side (e.g., bottom side) opposite to the first side of the display panel 100.

The lower gate lines GL21, GL22 and GL23 may be connected to output channels of the second gate drivers 223*a* and 223*b*. The second gate drivers 223*a* and 223*b* are respectively disposed at the third side and the fourth side in the lower portion of the display panel 100.

The lower pixels Pb may receive data voltages through the lower data lines DL21, DL22, DL23, DL24, DL25, DL26, DL27, DL28 and DL29. The lower pixels Pb may receive gate signals through the lower gate lines GL21, GL22 and GL23.

A plurality of third (boundary) pixel rows BR1, BR2 and BR3 are arranged in the boundary display area BDA. A boundary pixel row includes pixels from the plurality of upper pixels Pa which is connected to the output channels of the first data driver 212 and the plurality of lower pixels Pb which is connected to the output channels of the second data driver 222.

For example, a first boundary pixel row BR1 includes upper pixels Pa12 and Pa 18 and lower pixels Pb11, Pb13, Pb14, Pb15, Pb16, Pb17 and Pb19, which are connected to a first upper gate line GL11. The upper pixels Pa12 and Pa18 are respectively connected to the upper data lines DL12 and DL18 and the lower pixels Pb11, Pb13, Pb14, Pb15, Pb16, Pb17 and Pb19 are respectively connected to the lower data lines DL21, DL23, DL24, DL25, DL26, DL27 and DL29.

A second boundary pixel row BR2 includes upper pixels Pa21, Pa22, Pa23, Pa27, Pa28 and Pa29 and lower pixels Pb24, Pb25 and Pb26, which are connected to a second upper gate line GL12. The upper pixels Pa21, Pa22, Pa23, Pa27, Pa28 and Pa29 are respectively connected to the upper data lines DL11, DL12, DL13, DL17, DL18 and DL19 and the lower pixels Pb24, Pb25 and Pb26 are respectively connected to the lower data lines DL24, DL25 and DL26.

A third boundary pixel row BR3 includes upper pixels Pa31, Pa32, Pa33, Pa34, Pa36, Pa37, Pa38 and Pa39 and a lower pixel Pb35, which are connected to a second upper gate line GL12. The upper pixels Pa31, Pa32, Pa33, Pa34, Pa36, Pa37, Pa38 and Pa39 are respectively connected to the upper data lines DL11, DL12, DL13, DL14, DL16, DL17, DL18 and DL19 and the lower pixel Pb35 are respectively connected to the lower data line DL25.

The boundary pixel rows BR1, BR2 and BR3 are connected to the first to third upper gate lines GL11, GL12 and GL13 which are driven by the first gate driver 213*a* and thus, a number of the upper pixels in the boundary pixel rows BR1, BR2 and BR3 may increase along the first scan direction SD1. In addition, the boundary pixel rows BR1, BR2 and BR3 may be connected to the first to third lower gate lines GL21, GL22 and GL23 which are driven by the second gate driver 223*a* and thus, a number of the lower pixels in the boundary pixel rows BR1, BR2 and BR3 may increase along the second scan direction SD2.

According to the exemplary embodiment of the inventive concept, the plurality of boundary pixel rows BR1, BR2 and BR3 in the boundary display area BDA are driven by the first gate drivers 213*a* and 213*b* which drive the upper gate lines in the upper display area UD, but are not limited thereto. The plurality of boundary pixel rows BR1, BR2 and BR3 may be driven by the second gate drivers 223*a* and 223*b* which drive the lower gate lines in the lower display area LDA.

Figure 3:
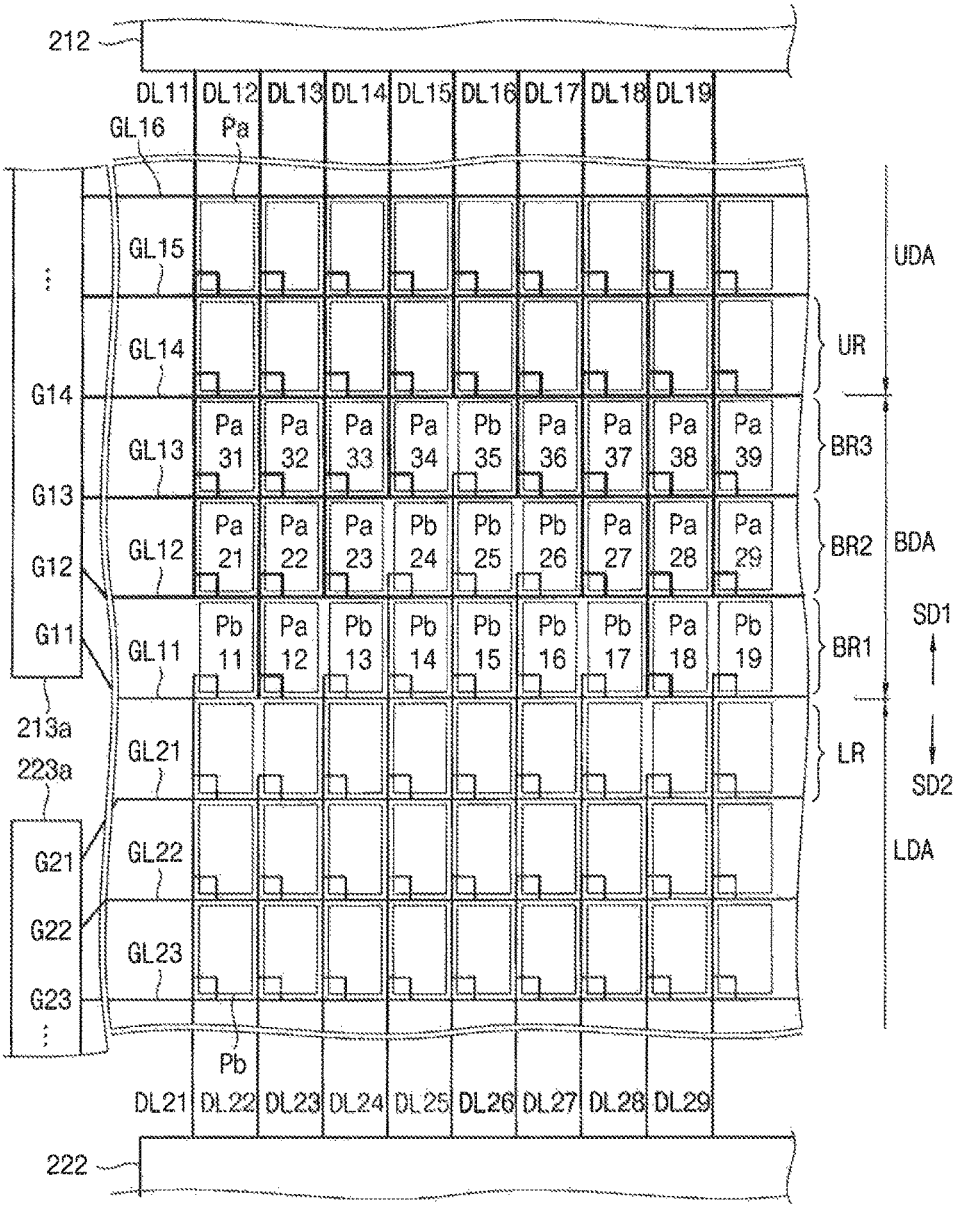
FIG. 3 is a diagram illustrating a method of driving the display apparatus of FIG. 1 according to an exemplary embodiment of the inventive concept.
Figure 4:
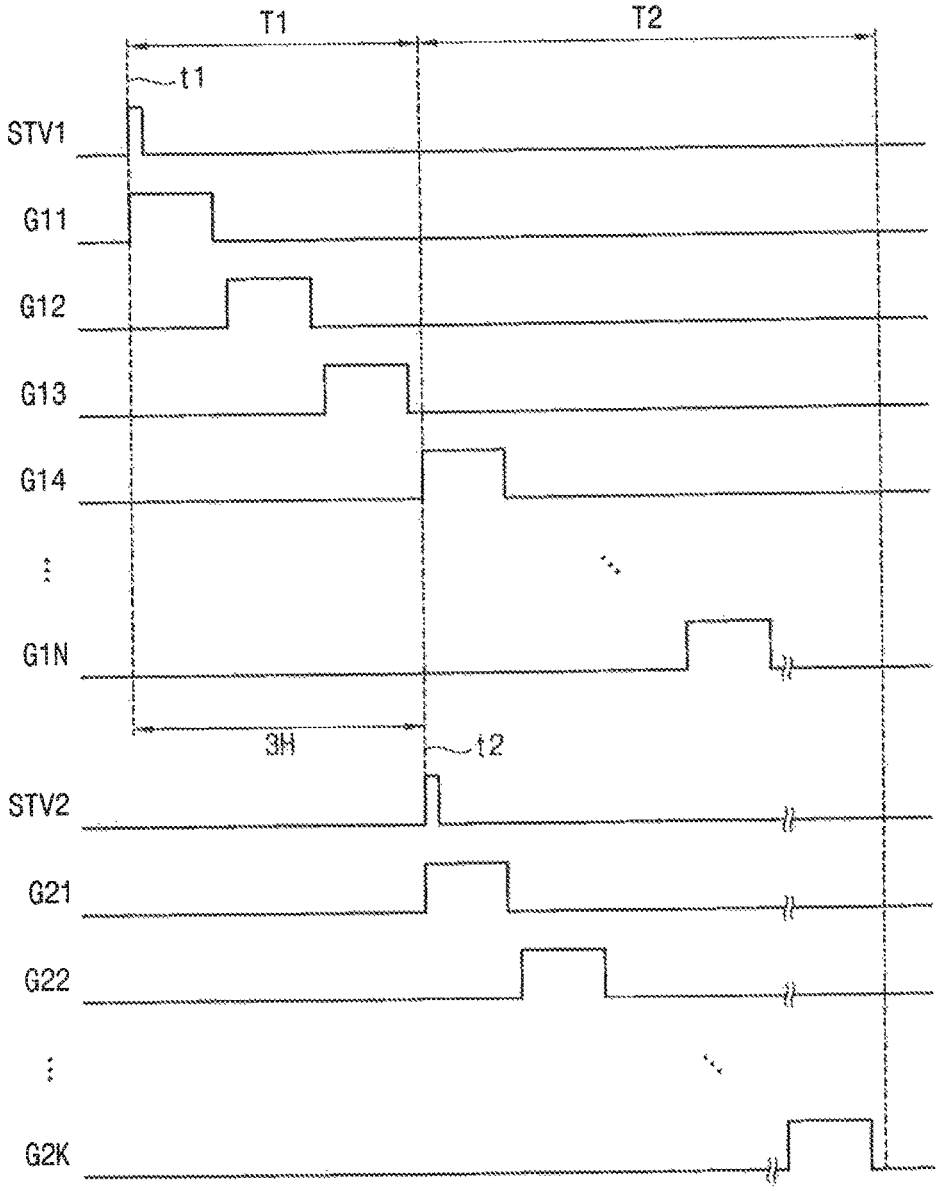
FIG. 4 is a waveform diagram illustrating a method of driving a gate driver according to an exemplary embodiment of the inventive concept.

FIG. 3 is a diagram illustrating a method of driving the display apparatus of FIG. 1 according to an exemplary embodiment of the inventive concept. FIG. 4 is a waveform diagram illustrating a method of driving a gate driver according to an exemplary embodiment of the inventive concept.

Referring to FIGS. 3 and 4, during an early first period T1 of an active period in a frame, the boundary pixel rows in the boundary display area BDA are sequentially driven along the first scan direction SD1.

Then, during a second period T2 of the active period, the upper pixel rows in the upper display area UDA are sequentially driven along the first scan direction SD1. In addition, during the second period T2 of the active period, the lower pixel rows in the lower display area LDA are sequentially driven in synchronization with the upper pixel rows along a second scan direction SD2 opposite to the first scan direction SD1.

For example, the first gate driver 213*a* starts an operation, of driving a portion of the display panel at a first time t1, which is a start time of the first period T1. The beginning of the first period T1 is initiated by a first vertical start signal STV1 included in a first display synchronization signal. The first gate driver 213*a* generates first to N-th upper gate signals G11, G12, . . . , G1N and sequentially outputs the first to N-th upper gate signals G11, G12, . . . ,G1N to a plurality of upper gate lines GL11 to GL1N in the upper display area UDA along the first scan direction SD1.

The second gate driver 223*a* starts an operation, of driving a portion of the display panel at a second time t2 which is delayed by 3 horizontal periods (3H) from the first time t1 and is a start time of the second period T2. The beginning of the second period T2 is initiated by a second vertical start signal STV2 included in a second display synchronization signal. The second gate driver 223*a* generates a first to K-th lower gate signals G21, G22, . . . ,G2K and to sequentially output the first to K-th lower gate signals G21, G22, . . . ,G2K to a plurality of lower gate lines GL21 to GL2K in the lower display area LDA along the second scan direction SD2.

Figure 5:
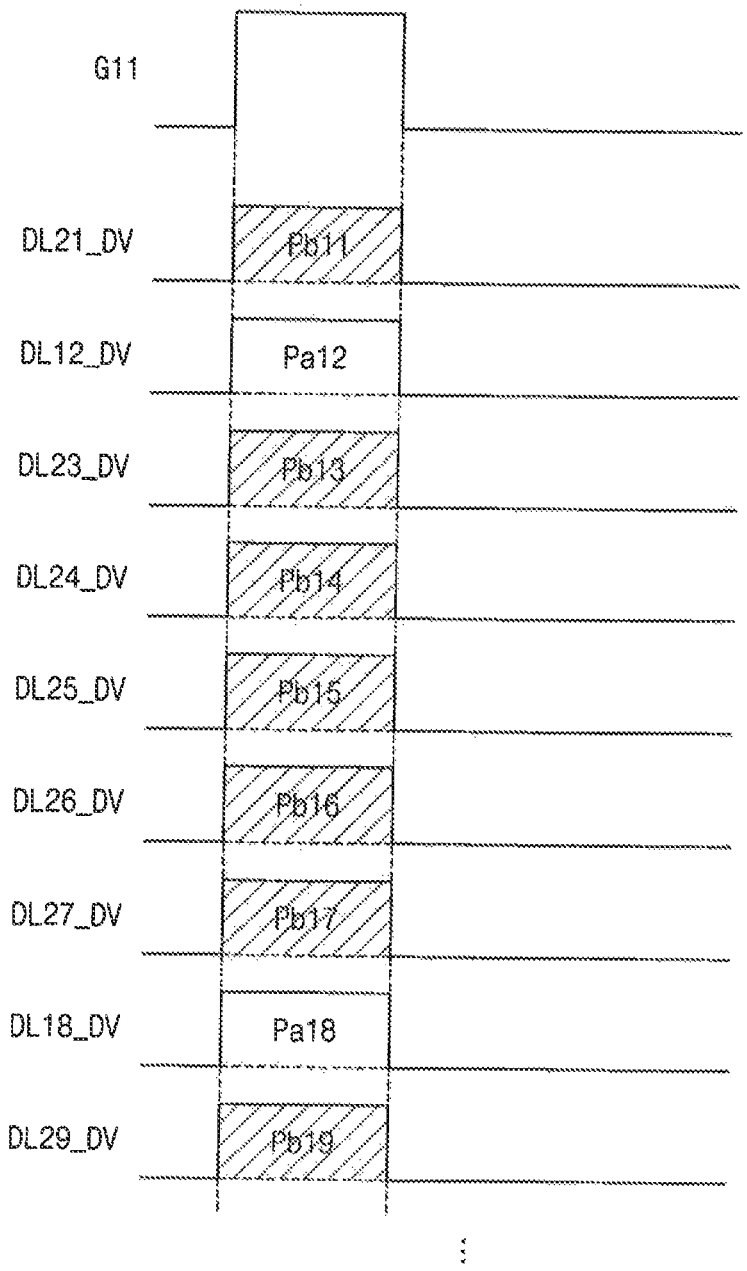
FIG. 5 is a waveform diagram illustrating a method of driving a data driver according to an exemplary embodiment of the inventive concept.
Figure 6:
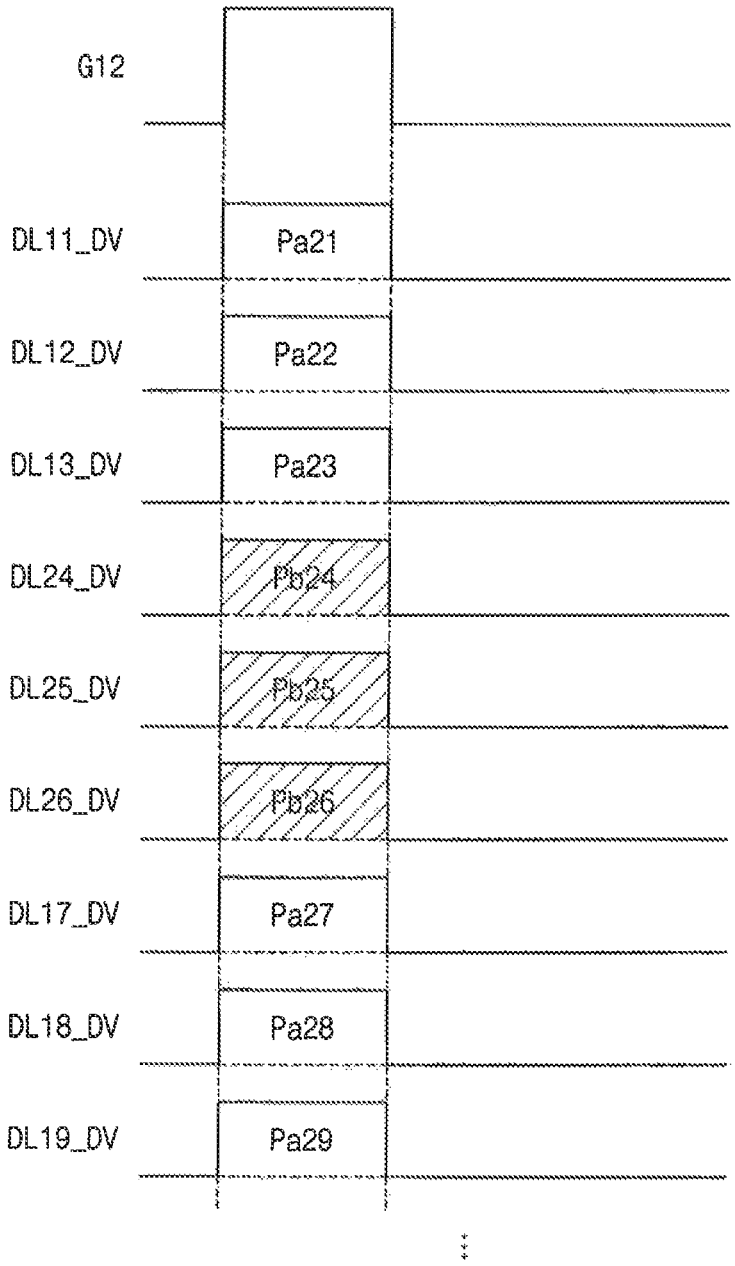
FIG. 6 is a waveform diagram illustrating a method of driving a data driver according to an exemplary embodiment of the inventive concept.
Figure 7:
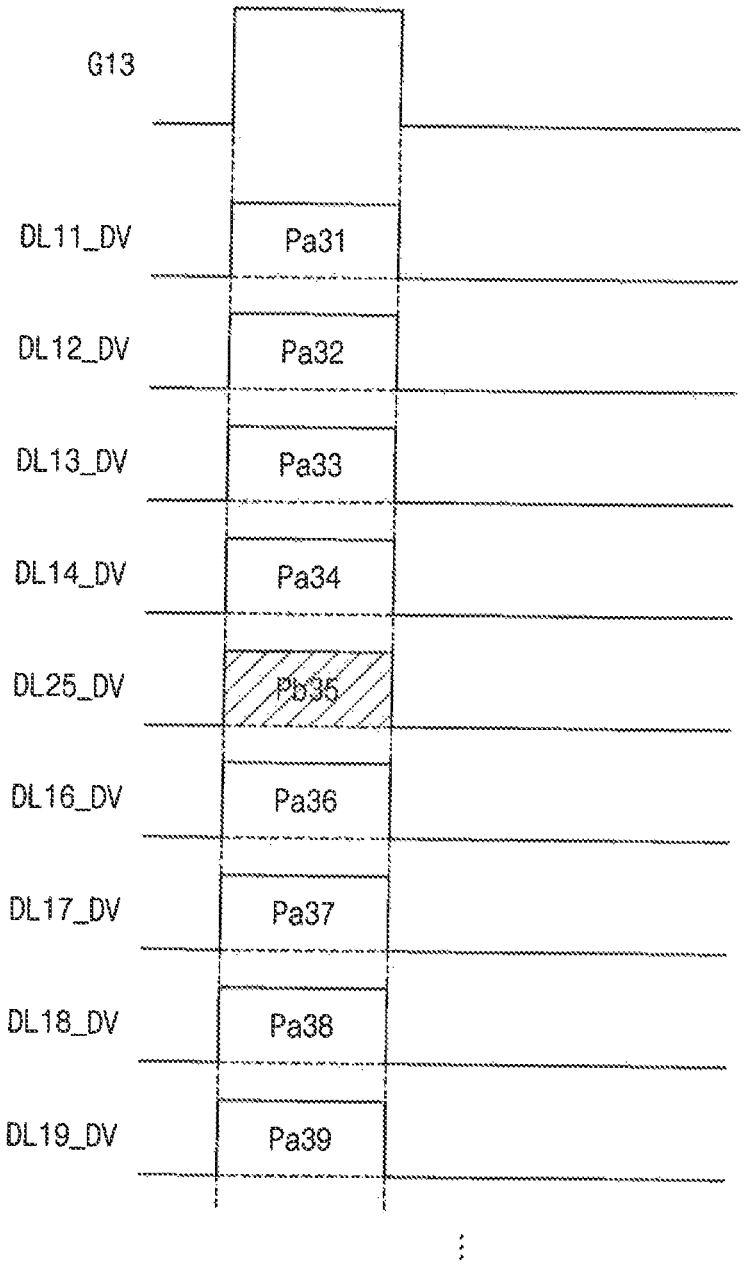
FIG. 7 is a waveform diagram illustrating a method of driving a data driver according to an exemplary embodiment of the inventive concept.

FIG. 5 is a waveform diagram illustrating a method of driving a data driver according to an exemplary embodiment of the inventive concept. FIG. 6 is a waveform diagram illustrating a method of driving a data driver according to an exemplary embodiment of the inventive concept. FIG. 7 is a waveform diagram illustrating a method of driving a data driver according to an exemplary embodiment of the inventive concept.

Referring to FIGS. 3 to 7, the first boundary pixel row BR1 in the boundary display area BDA includes the upper pixels Pa12 and Pa18 and the lower pixels Pb11, Pb13, Pb14, Pb15, Pb16, Pb17 and Pb19.

The upper pixels Pa12 and Pa18 are connected to second and eighth upper data lines DL12 and DL18. When the first upper gate signal Gil is applied to the first upper gate line GL11, data voltages DL12_DV and DL18_DV received through the second and eighth upper data lines DL12 and DL18 are applied to the upper pixels Pa12 and Pa18. The data voltages DL12_DV and DL18_DV may have a positive polarity or a negative polarity according to an inversion driving mode. For example, a polarity of the data voltages DL12_DV and DL18_DV may have a positive polarity.

In addition, the lower pixels Pb11, Pb13, Pb14, Pb15, Pb16, Pb17 and Pb19 are respectively connected to the lower data lines DL21, DL23, DL24, DL25, DL26, DL27 and DL29. When the first upper gate signal G11 is applied to the first upper gate line GL11, data voltages DL21_DV, DL23_DV, DL24_DV, DL25_DV, DL26_DV, DL27_DV and DL29_DV received through the lower data lines DL21, DL23, DL24, DL25, DL26, DL27 and DL29 are applied to the lower pixels Pb11, Pb13, Pb14, Pb15, Pb16, Pb17 and Pb19.

A second boundary pixel row BR2 in the boundary display area BDA includes upper pixels Pa21, Pa22, Pa23, Pa27, Pa28 and Pa29 and lower pixels Pb24, Pb25 and Pb26.

The upper pixels Pa21, Pa22, Pa23, Pa27, Pa28 and Pa29 are respectively connected to first, second, third, seventh, eighth and ninth upper data lines DL11, DL12, DL13, DL17, DL18 and DL19. When the second upper gate signal G12 is applied to the second upper gate line GL12, data voltages DL11_DV, DL12_DV, DL13_DV, DL17_DV, DL18_DV and DL19_DV received from the first, second, third, seventh, eighth and ninth upper data lines DL11, DL12, DL13, DL17, DL18 and DL19 are applied to the upper pixels Pa21, Pa22, Pa23, Pa27, Pa28 and Pa29.

In addition, the lower pixels Pb24, Pb25 and Pb26 are respectively connected to fourth, fifth and sixth lower data lines DL24, DL25 and DL26. When the second upper gate signal G12 is applied to the second upper gate line GL12, data voltages DL24_DV, DL25_DV, DL26_DV received from the fourth, fifth and sixth lower data lines DL24, DL25 and DL26 are applied to the lower pixels Pb24, Pb25 and Pb26.

A third boundary pixel row BR2 in the boundary display area BDA includes upper pixels Pa31, Pa32, Pa33, Pa34, Pa36, Pa37, Pa38 and Pa39 and a lower pixel Pb35.

The upper pixels Pa31, Pa32, Pa33, Pa34, Pa36, Pa37, Pa38 and Pa39 are respectively connected to first, second, third, fourth, sixth, seventh, eighth and ninth upper data lines DL11, DL12, DL13, DL14, DL16, DL17, DL18 and DL19. When the third upper gate signal G13 is applied to the third upper gate line GL13, data voltages DL11_DV, DL12_DV, DL13_DV, DL14_DV, DL16_DV, DL17_DV, DL18_DV and DL19_DV received from the first, second, third, fourth, sixth, seventh, eighth and ninth upper data lines DL11, DL12, DL13, DL14, DL16, DL17, DL18 and DL19 are applied to the upper pixels Pa31, Pa32, Pa33, Pa34, Pa36, Pa37, Pa38 and Pa39.

In addition, the lower pixel Pb35 is connected to the lower data line DL25. When the third upper gate signal G13 is applied to the third upper gate line GL13, data voltage DL25_DV received from the lower data line DL25 are applied to the lower pixel Pb35.

According to the exemplary embodiments of the inventive concept, the cut portions CT disconnecting the upper data lines in the upper display area and the lower data lines in the lower display area are arranged in a zigzag shape in the boundary display area. In other words, the cut portions CT are non-linearly arranged. Thus, the cut portions CT arranged as the zigzag shape may not be viewed a horizontal line in a half-cut area of the boundary display area. Therefore, reducing defects in a display apparatus employing the display panel While the inventive concept has been particularly shown and described with reference to exemplary embodiments thereof, it will be understood that various changes in form and details may be made therein without departing from the spirit and scope of the inventive concept as defined by the following claims.

What is claimed is:

1. A display panel comprising:

a plurality of first pixel rows comprising a plurality of first pixels, wherein the plurality of first pixels is connected to a plurality of first data lines;

a plurality of second pixel rows comprising a plurality of second pixels, wherein the plurality of second pixels is connected to a plurality of second data lines disconnected from the plurality of first data lines;

a plurality of third pixel rows comprising a portion of the plurality of first pixels and a portion of the plurality of second pixels, wherein the plurality of third pixel rows is arranged between the plurality of fist pixel rows and the plurality of second pixel rows;

a plurality of gate lines crossing at least one of the first and second data lines; and a plurality of cut portions disconnecting the plurality of first data lines and the plurality of second data lines, wherein the plurality of cut portions is disposed in the plurality of third pixel rows.

2. The display panel of claim 1, wherein the plurality of first pixel rows is arranged in an upper display area of the display panel and the plurality of second pixel rows is arranged in a lower display area of the display panel.

3. The display panel of claim 1, wherein the plurality of cut portions is arranged in a zigzag shape.

4. A display apparatus comprising:

a display panel comprising a first display area, a second display area and a third display area between the first and second display areas;

a plurality of first pixel rows comprising a plurality of first pixels, wherein the plurality of first pixels is connected to a plurality of first data lines and arranged in the first display area;

a plurality of second pixel rows comprising a plurality of second pixels, wherein the plurality of second pixels is connected to a plurality of second data lines and disconnected from the plurality of first data lines and arranged in the second display area;

a plurality of third pixel rows comprising a portion of the plurality of first pixels and a portion of the plurality of second pixels and arranged in the third display area;

a first gate driver configured to start to drive a plurality of first gate lines at a first time; and a second gate driver configured to start to drive a plurality of second gate lines at a second time after the first time, wherein the plurality of first pixel rows is driven by the first gate driver, the plurality of second pixel rows is driven by the second gate driver and the plurality of third pixel rows is driven by the first or second gate driver, wherein a difference between the first time and the second time corresponds to a plurality of horizontal periods, wherein the plurality of horizontal periods corresponds to a number of the plurality of third pixel rows.

5. The display apparatus of claim 4, wherein the first gate driver is configured to sequentially output a first gate signal in a first scan direction, wherein the first gate signal proceeds from a central portion of the display panel to an upper portion of the display panel, and the second gate driver is configured to sequentially output a second gate signal in a second scan direction, wherein the second gate signal proceeds from the central portion of the display panel to a lower portion of the display panel.

6. The display apparatus of claim 5, wherein the plurality of first pixels and the plurality of second pixels in the plurality of third pixel rows are connected to the plurality of first gate lines, and a number of the first pixels in the plurality of third pixel rows increases along the first scan direction.

7. The display apparatus of claim 6, wherein the plurality of first pixels and the plurality of second pixels in the plurality of third pixel rows are connected to the plurality of second gate lines, and a number of the second pixels in the plurality of third pixel rows increases along the second scan direction.

8. The display apparatus of claim 4, wherein the display panel comprises a plurality of cut portions disconnecting the plurality of first data lines and the plurality of second data lines in the third display area, wherein the plurality of cut portions is arranged in a zigzag shape.

9. A method of driving a display panel which comprises a first display area, a second display area and a third display area between the first and second display areas, the method comprising:

sequentially driving a plurality of third pixel rows in the third display area during a first period;

sequentially driving a plurality of first pixel rows in the first display area along a first scan direction during a second period; and sequentially driving a plurality of second pixel rows in the second display area along a second scan direction opposite the first scan direction during the second period, wherein the plurality of first pixel rows comprises a plurality of first pixels, wherein the plurality of first pixels is connected to a plurality of first data lines, the plurality of second pixel rows comprises a plurality of second pixels, wherein the plurality of second pixels is connected to a plurality of second data lines, and the plurality of third pixel rows comprises a portion of the plurality of first pixels and a portion of the plurality of second pixels, and wherein the display panel comprises a plurality of cut portions disconnecting the plurality of first data lines and the plurality of second data lines in the third display area.

10. The method of claim 9, wherein the plurality of cut portions is arranged in a zigzag shape.

11. The method of claim 9, wherein the plurality of third pixel rows is sequentially driven along the first scan direction.

12. The method of claim 9, wherein the plurality of third pixel rows is sequentially driven along the second scan direction.

13. A display panel comprising:

a boundary area including a plurality of first pixels and a plurality of second pixels;

a first data driver connected to the plurality of first pixels by a plurality of first data lines;

a second data driver connected to the plurality of second pixels by a plurality of second data lines; and a plurality of cut portions separating the plurality of first data lines and the plurality of second data lines from each other, wherein the plurality of first pixels and the plurality of second pixels form a plurality of rows in the boundary area, and the plurality of cut portions is non-linearly arranged.

14. The display panel of claim 13, wherein the plurality of cut portions has a zigzag shape.

15. The display panel of claim 13, further comprising:

a first area including a plurality of third pixels;

a second area including a plurality of fourth pixels;

a first gate driver connected to the plurality of first pixels, the plurality of second pixels and the plurality of third pixels; and a second gate driver connected to the plurality of fourth pixels.

16. The display panel of claim 15, wherein the first gate driver drives the plurality of first pixels and the plurality of second pixels and, after a time delay, the first gate driver drives the plurality of third pixels and the second gate driver drives the plurality of fourth pixels.

* * * * *